US005575612A

United States Patent [19]

Uno

[11] Patent Number: 5,575,612

[45] Date of Patent: Nov. 19, 1996

[54] APPARATUS FOR STACKING BUNDLES OF SHEETS

[76] Inventor: Tadao Uno, 1-84, Matsugaoka 1-chome, Chigasaki-shi, Kanagawa-ken, Japan

[21] Appl. No.: 386,379

[22] Filed: Feb. 10, 1995

[30] Foreign Application Priority Data

Nov. 25, 1994 [JP] Japan ..... 6-315611

[51] Int. Cl.[6] ..... B65G 57/06

[52] U.S. Cl. ..... 414/788.9; 414/790.3; 414/793.4; 414/900

[58] Field of Search ..... 198/418.6; 414/790.3, 414/793.4, 794.3, 788.9, 900

[56] References Cited

U.S. PATENT DOCUMENTS

| | | | |
|---|---|---|---|
| 3,675,792 | 7/1972 | Griner et al. | 414/790.3 X |
| 4,015,724 | 4/1977 | Spencer | 414/790.3 X |
| 4,130,207 | 12/1978 | Cogswell et al. | 414/790.3 X |
| 4,369,015 | 1/1983 | Fabrig | 414/794.3 X |
| 4,927,321 | 5/1990 | Lucas | 414/788.9 |

FOREIGN PATENT DOCUMENTS

| | | | |
|---|---|---|---|
| 53-83263 | 7/1978 | Japan | 414/788.9 |
| 5-178520 | 7/1993 | Japan . | |
| 2268147 | 1/1994 | United Kingdom | 414/790.3 |

*Primary Examiner*—Karen Merritt
*Assistant Examiner*—Janice L. Krizek
*Attorney, Agent, or Firm*—Wenderoth, Lind & Ponack

[57] ABSTRACT

An apparatus for stacking bundles of sheets includes an elongate stacking table capable of movement upwardly and downwardly, the stacking table being lowered in accordance with an increase in stacking amount of the bundles of sheets. A single-side-openable type shutter member is located above the stacking table and is adapted to support the bundles of sheets arranged in a row, the shutter member being capable of opening only in the direction perpendicular to the direction of the bundles of sheets being arranged in a row, so that the bundles of sheets are simultaneously dropped onto the stacking table. A stationary ruler member is adapted to restrict only one side surface of the bundles of sheets at the openable side of the shutter member and prevent the bundles of sheets from movement following the opening action of the shutter member so that the bundles of sheets are dropped to a predetermined location. A reciprocally movable expulsion pusher adapted to push blocks of the bundles of sheets dropped onto and supported in a row in their horizontal posture by an upper surface of the stacking table simultaneously in the direction perpendicular to the direction of the blocks being arranged in a row.

7 Claims, 5 Drawing Sheets

APPARATUS FOR STACKING BUNDLES OF SHEETS

BACKGROUND OF THE INVENTION

1. Field of the Invention

This invention relates to a sheet-bundle stacking apparatus, and more particularly to an apparatus for stacking a plurality of bundles of sheets, each bundle being properly banded, in their horizontal postures so as to be subjected to the subsequent packing process.

2. Brief Description of the Related Art

As a typical packing method for papers of value such as, for example, bank notes, constant numbers of sheets (for example, one hundred sheets) are banded to form bundles of sheets, and constant numbers of such bundles of sheets (for example, ten bundles) are stacked in their horizontal posture to form blocks of bundles of sheets and again banded so that, in this way, the bank notes are packed in a serial ordinator. This packing method is likewise applicable to other papers of value such as security papers, post cards, lottery tickets and the like.

In a known apparatus for stacking bundles of sheets as discussed, for example, in Japanese Laid-open Patent Application No. Hei 5-178520, a group of bundles of sheets received in the arrangement of a row from the preceding process are carried at two opposite sides of their lower surfaces by a sheet-bundle pool table which comprises a pair of support plates, and this pool table is opened at opposite sides of the group of bundles of sheets so that the group of bundles of sheets are dropped onto a stacking table below the pool table. This procedure is repeatedly performed to stack the bundles of sheets in their horizontal posture on the stacking table. The bundles of sheets are pooled on the pool table and stacked on the stacking table while being restricted by pairs of opposing side ruler plates disposed along two opposite sides in the longitudinal direction of the pool table and stacking table. As the number of bundles of sheets stacked thereon is increased, the stacking table is lowered along the inner sides of the side ruler plates, thereby forming many blocks of constant numbers of bundles of sheets on the stacking table.

The blocks of the constant numbers of bundles of sheets stacked in their horizontal posture are transferred in a row along a path between the side ruler plates, by a pusher traveling along the path and gradually expelled, one block by one block, from an exit at a distal end of the path, first with the leading block. After completion of the expulsion of the last block, another procedure for stacking blocks of sheets onto the stacking table is resumed.

However, the conventional sheet-block stacking apparatus of the type mentioned has the shortcomings in that since many blocks of bundles of sheets stacked in their horizontal posture on the stacking table are expelled, one block by one block, from the exit which is located at the distal end of the path, it is necessary to stop the subsequent operation for stacking blocks of sheets during the time of expulsion of the previously stacked blocks and it is only after the completion of the expulsion of the last block that the subsequent stacking operation can be resumed. This is naturally inefficient in working performance and cannot meet the requirement of a highspeed stacking operation.

Further, since the pool table, which supports the bundles of sheets at two opposite sides thereof and drops them onto the stacking table therebelow, is of the construction openable at opposite sides thereof (i.e., two-sides open structure), it is not only complicated in structure but also inefficient in space, cost, etc. Sometimes, it becomes practically impossible to secure a space for forming a two-sides open structure depending on the line formation.

Also, in order to cope with a change in sheet size of the bundles, there is a need for the provision of a space adjusting mechanism for adjusting the spaces between the side ruler plates and between the two openings of the pool table, and this again makes the overall construction of the apparatus even more complicated.

Also, during the time the blocks of the bundles of sheets are transferred over a comparatively long distance and gradually expelled from one end of the stacking table by a pusher, the entire side surfaces of each block are contacted with and rubbed by the inner surfaces of the side ruler plates, and as a result, the bundles of sheets suffer from scratches.

The present invention has been accomplished in view of the above problems inherent in the prior art devices.

SUMMARY OF THE INVENTION

It is, therefore, an object of the present invention to provide an apparatus for stacking bundles of sheets, which is capable of performing a stacking operation of bundles of sheets at a high speed and which is simple in construction.

To achieve the above object, there is essentially provided an apparatus for stacking bundles of sheets comprising an elongate stacking table capable of movement upwardly and downwardly, the stacking table being lowered in accordance with an increase in stacking amount of the bundles of sheets; a single-side-openable type shutter member located above the stacking table and adapted to support the bundles of sheets arranged in a row, the shutter member being capable of opening only in the direction perpendicular to the direction of the bundles of sheets being arranged in a row, so that the bundles of sheets are simultaneously dropped onto the stacking table; a stationary ruler member adapted to restrict only one side surface of the bundles of sheets at the openable side of the shutter member and prevent the bundles of sheets from movement following the opening action of the shutter member so that the bundles of sheets are dropped to a predetermined location; and a reciprocally movable expulsion pusher adapted to push blocks of the bundles of sheets dropped onto and supported in a row in their horizontal posture by an upper surface of the stacking table simultaneously in the direction perpendicular to the direction of the blocks being arranged in a row.

It is preferred that a projection, reciprocally movable within a groove formed in the upper surface of the stacking table in accordance with the reciprocal movement of the expulsion pusher, is formed on a lower edge of the expulsion pusher.

The expulsion pusher may include a plurality of unit expulsion pushers divided so as to correspond to the respective blocks of the bundles of sheets stacked in their horizontal posture, and each unit expulsion pusher is adjustable in the width of a pressing surface thereof with respect to each of the blocks.

According to the present invention thus constructed, when the shutter member is opened at its one side, the bundles of sheets are prevented from movement by the stationary ruler member disposed on the openable-side. Accordingly, there can be effectively prevented a possible movement of the bundles of sheets following the opening action of the shutter member. Thus, it is ensured that the bundles of sheets are always dropped to a predetermined location.

Also, since the other end side of the shutter member is normally open, the bundles of sheets are not restricted. If the shutter member has a satisfactory width which is not necessarily very large, it can properly meet any change in size of the bundles of sheets whenever necessary.

Also, since the shutter member for supporting the bundles of sheets at one side thereof is of a single-side-openable structure, the apparatus for stacking bundles of sheets can be simplified in structure.

Since the group of many blocks of the bundles of sheets stacked and supported in a row on the stacking table are simultaneously expelled in a direction of its one side by the expulsion pushers, the blocks can be expelled from the stacking table in a comparatively short time, thus enabling the starting of the next stacking operation immediately. Therefore, the cycle from the time for stacking the bundles of sheets to the time for expelling the blocks of the bundles of sheets is short. Therefore, there can be obviated the problem inherent in the conventional devices that the next stacking operation is interrupted during the time the blocks are expelled, one-by-one, from one end of the stacking table. As a result, the present invention can improve the working efficiency and meet the requirement of a high speed operation.

Also, since the group of the blocks of the bundles of sheets can be simultaneously expelled by the expulsion pushers in a direction perpendicular to the direction of the row of the group of the blocks, i.e., a direction perpendicular to the longitudinal direction of the stacking table, there can be obviated the problems inherent in the conventional devices that the sheet-blocks are scratched by the inner surfaces of the opposite side ruler plates. In addition, owing to the provision of a protrusion formed on a lower edge of each expulsion pusher, there can be effectively prevented the possible troubles in which the lowermost sheet moves beneath the lower edge of the expulsion pusher to generate a product of poor quality and requiring that the operation be stopped. Thus, the expelling operation can be performed in an efficient manner.

Also, owing to the arrangement in which a plurality of unit expulsion pusher members corresponding to the blocks can be adjusted in pressing width, any change in size of the bundles of sheets can be properly met, where necessary.

For a better understanding of the present invention, together with other and further objects thereof, reference is made to the following description, taken in connection with the accompanying drawings, while its scope will be pointed out in the appended claims.

DETAILED DESCRIPTION OF THE EMBODIMENT

Figure 1:
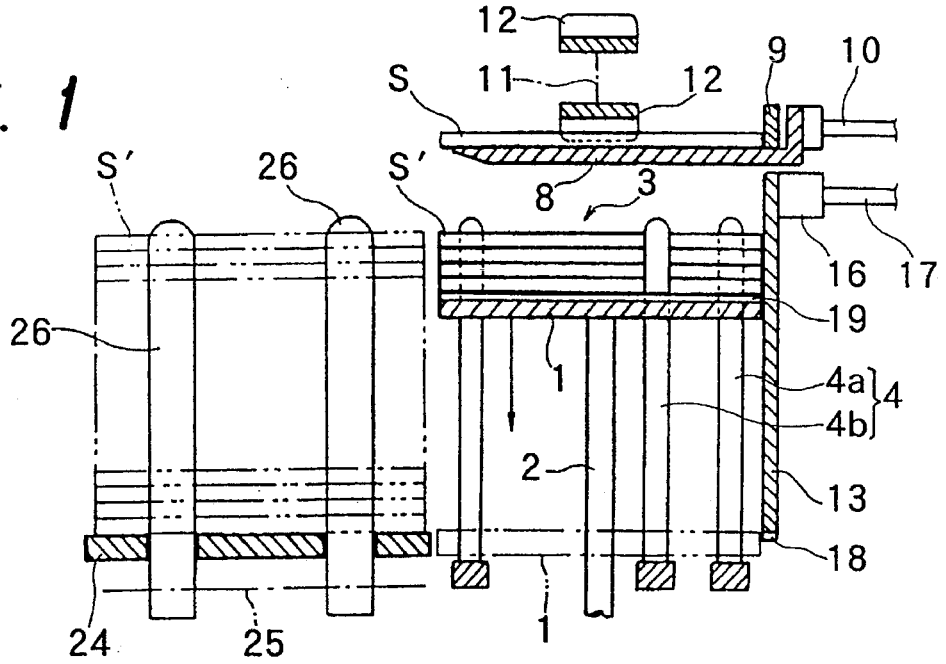
FIG. 1 is a cross-sectional view of an apparatus for stacking bundles of sheets, according to one embodiment of the present invention.
Figure 2:
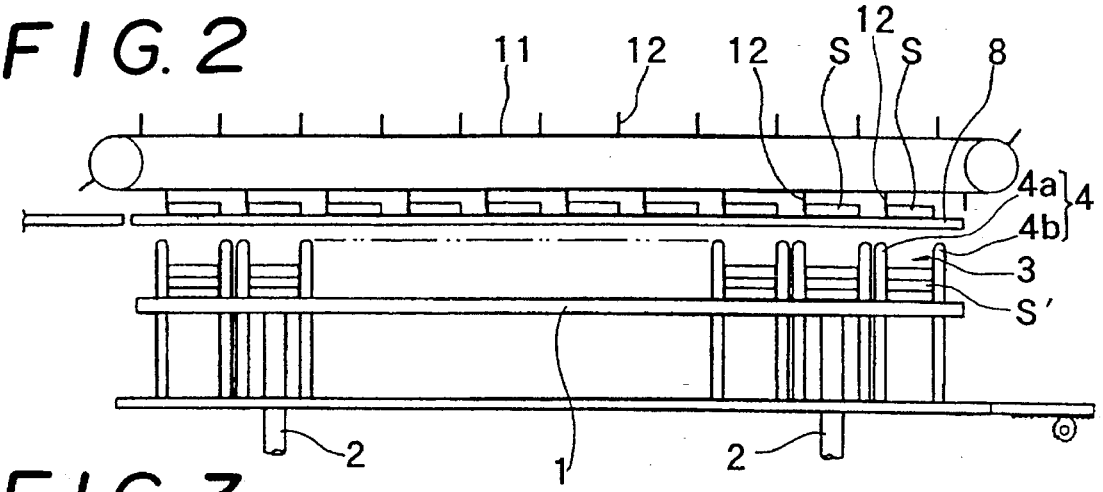
FIG. 2 is a side view of FIG. 1.

One embodiment of the present invention will now be described in great detail with reference to FIGS. 1 to 9 inclusive.

Reference numeral 1 denotes an elongate horizontal stacking table, this table 1 being movable upwardly and downwardly, on which bundles of sheets S are stacked in their horizontal posture, through a plurality of collection stations 3 which are arranged, side by side, on the stacking table 1 over the entire length thereof. The collection stations 3 are defined by such station defining means as unit guide pins 4 (4*a*, 4*b*) which are adapted to restrict two opposite ends of the bundles of sheets S. The unit guide pins 4 are cylindrical and are through pierced the stacking table 1 such that distal ends of the unit guide pins 4 are allowed to extend vertically upwardly from the upper surface of the stacking table 1. The stacking table 1 can be moved upwardly and downwardly by an elevating device 2 comprised, for example, of a pneumatic or hydraulic cylinder, along the unit guide pins 4.

Accordingly, the bundles of sheets S are dropped within the respective collection stations 3 from above the unit guide pins 4. By repeating this dropping procedure, the bundles of sheets S are stacked in their horizontal posture on the stacking table 1. As the stacking amount of the bundles of sheets S is increased, the stacking table 1 is lowered by the elevating device 2. At the lower dead point, constant numbers of blocks S' of the bundles of sheets are formed in a row on the stacking table 1.

As means for stacking the bundles of sheets S, namely, means for dropping the bundles of sheets S to the collection station 3, a single-side-openable type horizontal shutter member 8 having an elongate shape is disposed at a location above the stacking table 1 in such a manner as to extend in a parallel relation with the stacking table 1.

The single-side-openable type shutter member 8 is dimensioned such that the length of each end (i.e., short side) thereof is Just enough to support the overall lower surface of the bundle of sheets S thereabove and the length of each side (i.e., long side) corresponds generally to the full longitudinal length of the stacking table 1. The shutter member 8 receives the bundles of sheets S delivered from the preceding process such that the received bundles of sheets S are arranged in a row over the entire longitudinal length of the shutter member 8. Specifically, a corresponding number of the bundles of sheets S to that of the stacking stations 3 are received and thereafter, the single-side-openable type shutter is opened only in the direction perpendicular to the direction of the bundles of sheets S being arranged in a row and one group of the bundles of sheets S are simultaneously dropped onto the stacking table 1.

The shutter member 8 is provided at one side edge (edge portion on the openable side) thereof, this side edge extending in the longitudinal direction of the shutter member 8, with a stationary ruler member 9 for restricting only one side surface of each bundle of sheets S, and the other side edge (edge portion opposite to the openable side) of the shutter member 8 is left open and from this open side, the group of the bundles of sheets S are simultaneously dropped onto the stacking table 1.

Figure 4A:
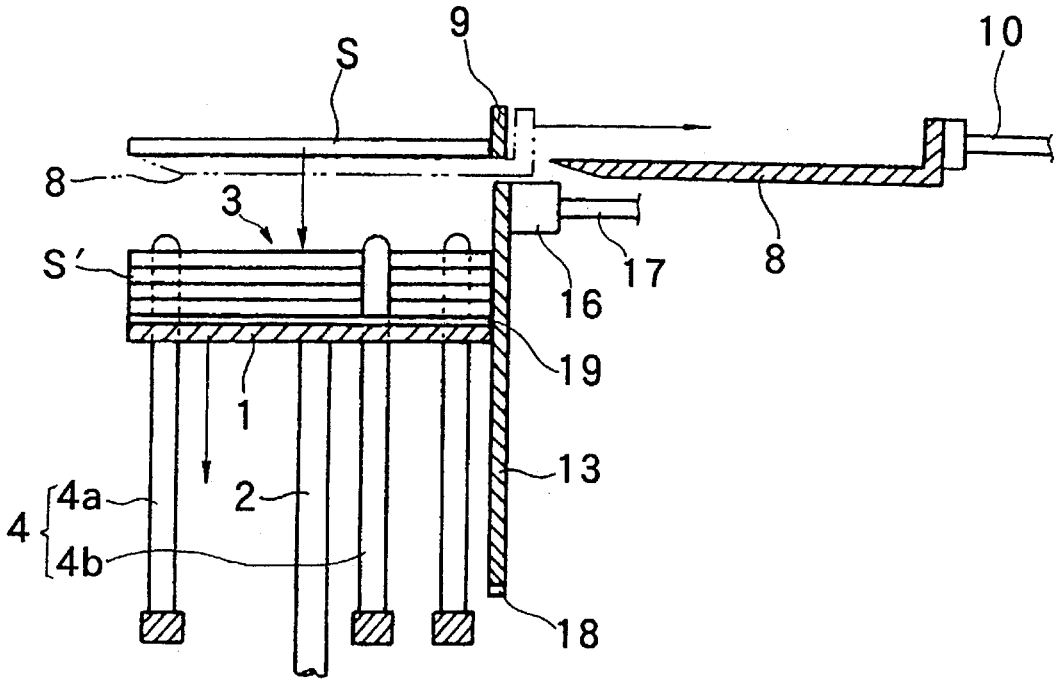
FIG. 4(A) is a cross-sectional view for explaining the operation of a single-side-openable type shutter member for the bundles of sheets stacked in their horizontal posture.
Figure 4:
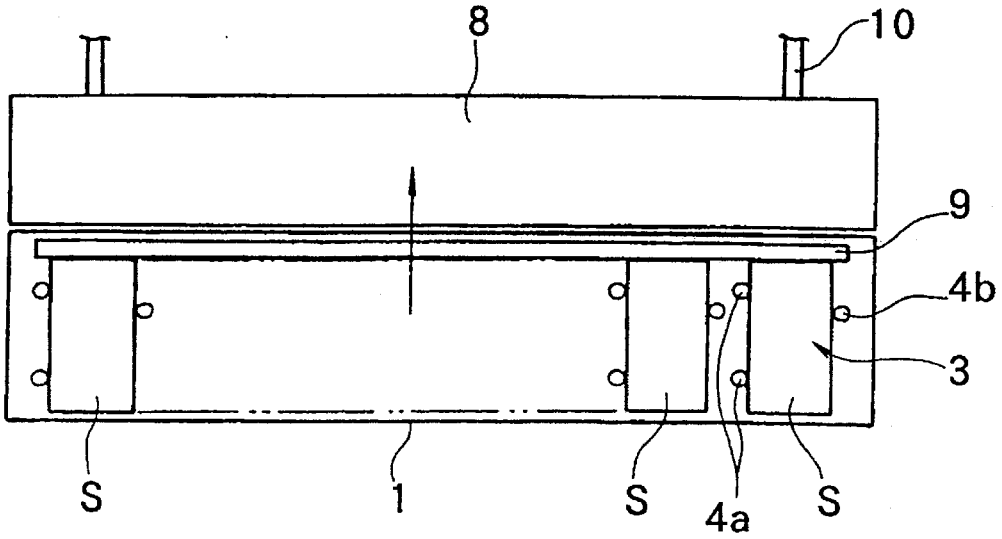
FIG. 4(B) is a plan view of FIG. 4(A)

The stationary ruler member 9 is fixedly positioned in order not to open at one side thereof together with the shutter member 8. The stationary ruler member 9 is also functions as a stopper for preventing each bundle of sheets S from moving in the opening direction of the shutter member 8 when the shutter 8 is opened at its single side as shown in FIG. 4. With this arrangement, it is ensured that the bundles of sheets S are dropped to a predetermined location of the stacking table 1.

The single-side-openable type shutter member 8 is caused to move horizontally in the short direction of the stacking table 1 by a reciprocation means 10 such as, for example, a fluid pressure cylinder, in order to be opened and closed. When opened, the shutter member 8 allows the bundles of sheets S to drop. After dropping the bundles of sheets S, the shutter member 8 is returned to the original position. As soon as the shutter member 8 is returned to the original position, it resumes the receiving operation of the next bundles of sheets S.

As means for receiving the bundles of sheets S onto the shutter member 8, there is employed an endless traveling body 11 laid over and in parallel relation with the shutter member 8 and which travels intermittently. The endless traveling body 11 includes a plurality of sheet-bundle charge pushers 12 arranged thereon at equal intervals. The bundles of sheets S transferred from the preceding process are each delivered onto the shutter member 8 by each of the pushers 12.

The charge pushers 12 are arranged with reference to the guide pins 4*a*, respectively, of the unit guide pins 4 which define the collection stations 3 formed on the stacking table 1. Owing to this arrangement, the bundles of sheets S are individually delivered onto the shutter member 8 at equal intervals by the charge pushers 12 in operation. After the bundles of sheets S have been delivered in place (i.e., locations corresponding to the collection stations 3), the operation of the charge pushers 12 is stopped.

Thereafter, the shutter member 8 is opened to allow the bundles of sheets S, which have been received in a row, to drop simultaneously into the collections stations 3 along the unit guide pins 4 so that the bundles of sheets S are stacked in their horizontal posture on the stacking table 1. After dropping the bundles S of sheets, the shutter member 8 is returned to the original position. As soon as the shutter member 8 is returned to the original position, the charge pushers 12 are operated to deliver the next bundles of sheets S onto the shutter member 8. That is, owing to the arrangement in that the charge pushers 12 are stopped at the locations corresponding to the guide pins 4a of the unit guide pins 4, the bundles of sheets S arranged in a row on the shutter member 8 are arranged at the locations corresponding to the collection stations 3. Therefore, the bundles of sheets S can be reliably dropped to constant position through coaction of the stationary ruler member 9 of the shutter member 8 and the unit guide pins 4.

The above procedure for dropping the bundles of sheets S is repeatedly performed and the bundles of sheets S are stacked in their horizontal posture on the stacking table 1. As the stacking amount is increased, the stacking table 1 is lowered by the elevating device 2. At the lower dead point, blocks S' of a constant number of sheet-bundles S are formed at each collection station 3.

Figure 3:
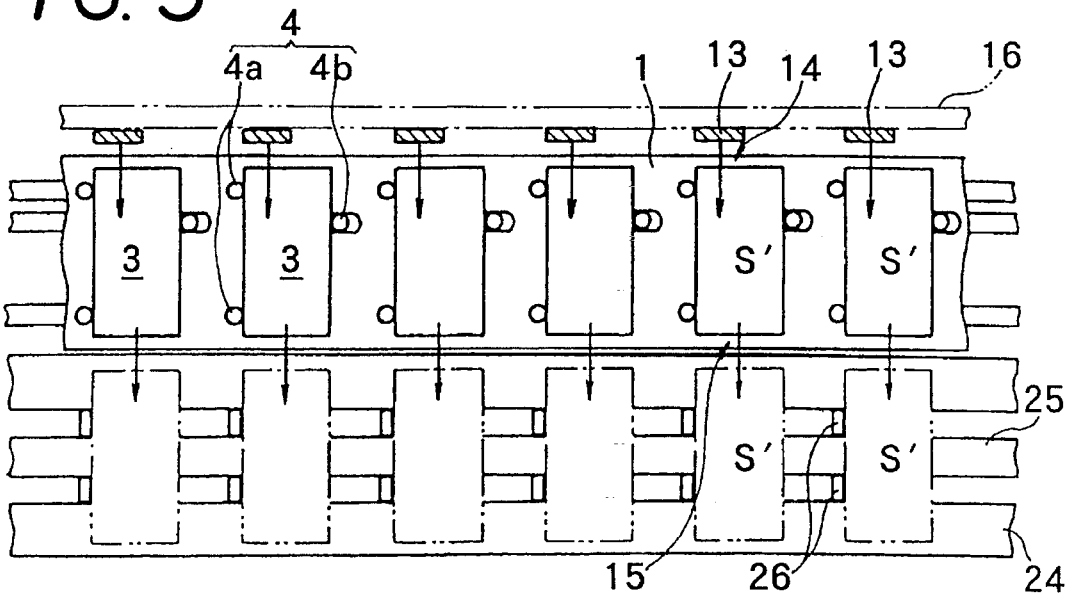
FIG. 3 is a plan view showing blocks of bundles of sheets a being expelled from a stacking table.

The blocks S' thus formed are pushed out for expulsion onto an elongate expulsion table 24 as later described, which is disposed in parallel relation with the stacking table 1. As means for expelling the blocks S', expulsion pushers 13 are each hung along one side surface of each block S'. The expulsion pushers 13 are arranged in such a manner as to correspond to the blocks S' along one side edge in the longitudinal direction of the stacking table 1. Each of the expulsion pushers 13 is installed, below the shutter member 8, at each collection station 3 and is reciprocally moved in the same directions as the opening and closing movements of the shutter member 8. The expulsion pushers 13 are designed such that the width of each pusher 13 corresponding to each collection station 3 is smaller than the interval between the guide pins 4*a* and 4*b*, i.e., interval between adjacent collection stations 3 as shown in FIG. 3, so that as illustrated, each expulsion pusher 13 is moved in and out of each collection station 3 along the guide pins 4*a* of the unit guide pins 4.

In other words, an inlet port 14 for each unit expulsion pusher 13 is formed in a direction perpendicular to the longitudinal direction of the elongate stacking table 1, i.e., a direction perpendicular to the direction of the row of the blocks S' arranged side by side on the stacking table 1, and an outlet port 15 for each block S' is formed in such a manner as to be opposite to the inlet port 14, so that each block S' formed in each collection station 3 is pushed out for expulsion from each outlet port 15 by each unit expulsion pusher 13 which entered into each collection station 3.

The unit expulsion pushers 13 corresponding to the collection stations 3 as previously mentioned, are mounted on a connection frame 16 extending in the longitudinal direction of and in parallel relation with the stacking table 1. For reciprocally moving the expulsion pushers 13, the connection frame 16 is reciprocally moved in a horizontal direction by a reciprocation means 17 such as, for example, a fluid pressure cylinder. In other words, the connection frame 16 is disposed at a higher location than distal ends of the unit guide pins 4 and from this location, the unit expulsion pushers 13 are hung down, so that the unit expulsion pushers 13 are simultaneously reciprocally moved by the reciprocation means 17 through the connection frame 16, thereby simultaneously expelling the blocks S' arranged in a row on the stacking table 1, in parallel relation.

After pushing out the blocks S', the expulsion pushers 13 are retracted to the original position and the stacking table 1 is lifted upwardly again to the upper dead point in order to resume the next stacking operation of the bundles of sheets S.

The expulsion pushers 13 may be commonly used as means for dropping the bundles of sheets S and restricting the side surface of the blocks S' by co-acting with station division means represented by the unit guide pins 4.

Figure 5:
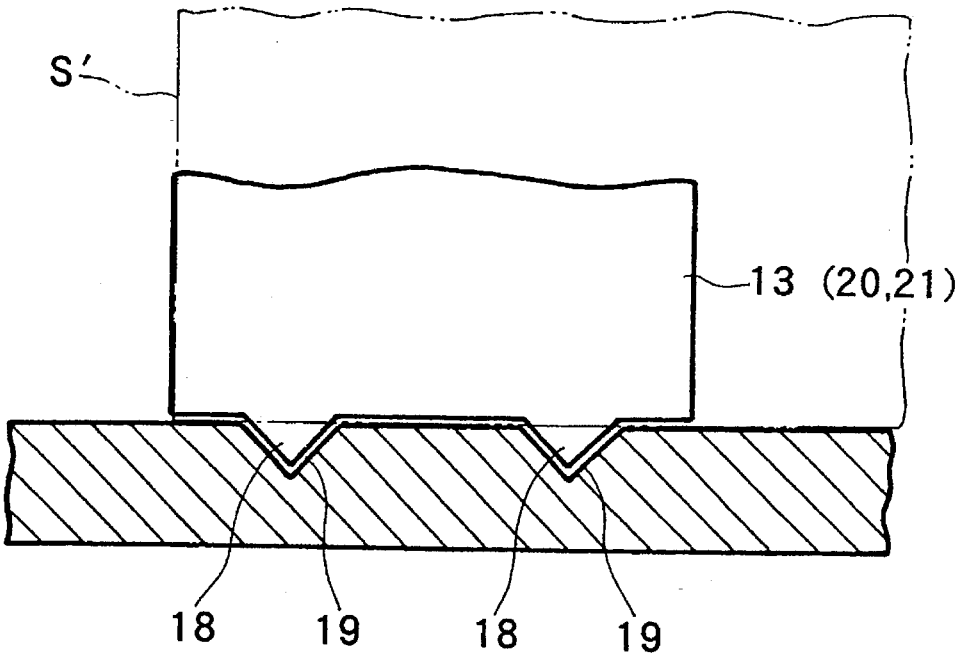
FIG. 5 is a sectional view showing an auxiliary pressing portion at a lower end of an expulsion pusher.
Figure 6:
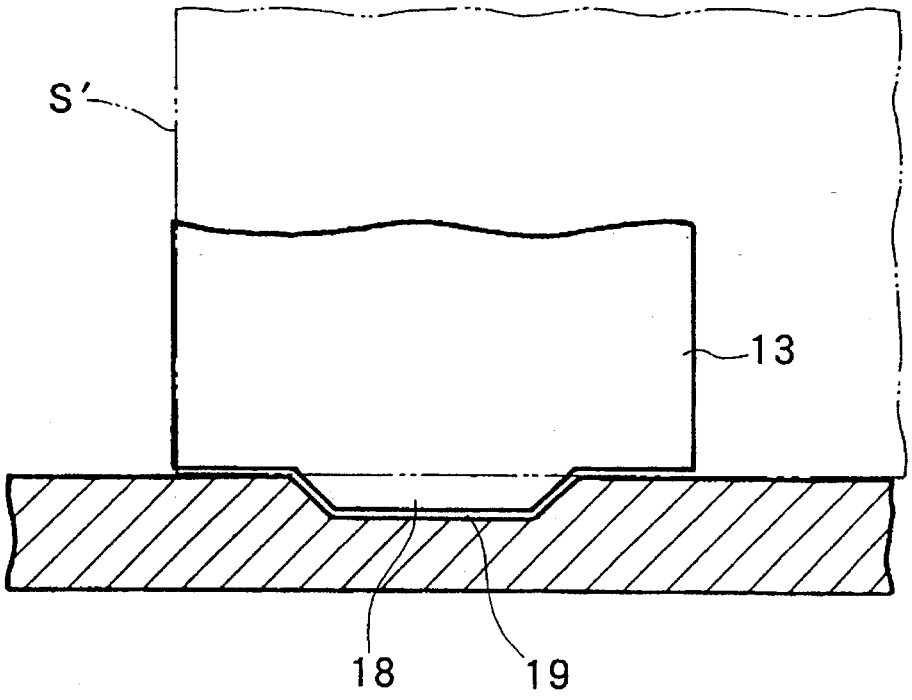
FIG. 6 is a sectional view showing a modified embodiment of the auxiliary pressing portion of FIG. 5.

Each expulsion pusher 13 has an auxiliary pressing portion formed by a protruding part of its lower edge. For example, two auxiliary pressing portions 18 are formed on opposite sides of a lower edge of each expulsion pusher 13 as shown in FIG. 5, or a single auxiliary pressing portion 18 is formed generally at its center as shown in FIG. 6. The auxiliary pressing portion or portions 18 are reciprocally moved within a guide groove or grooves 19 formed in the upper surface of the stacking table 1 for each collection station 3, in accordance with the in-and-out reciprocal movement of each unit expulsion pusher 13.

Figure 7A:
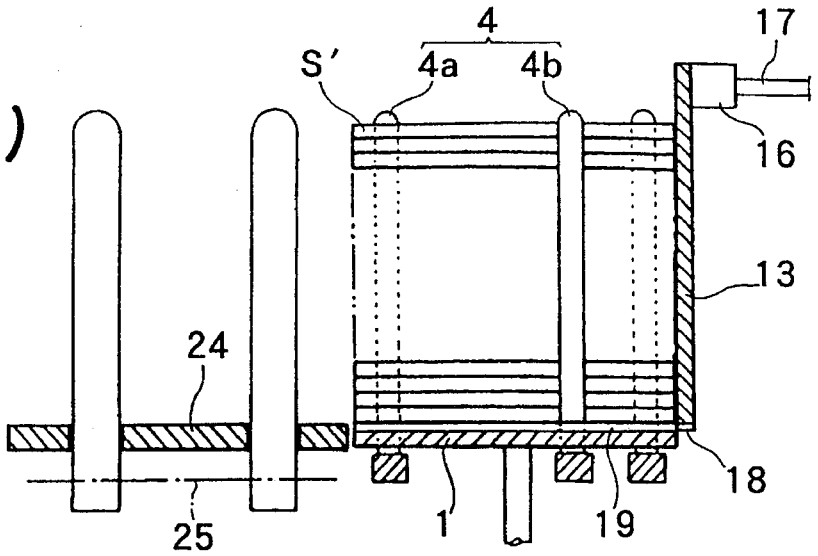
FIGS. 7(A), 7(B) and 7(C) are cross-sectional view of the sheet-bundle stacking portion and expulsion portion, for use in explaining the process of operation thereof.
Figure 7B:
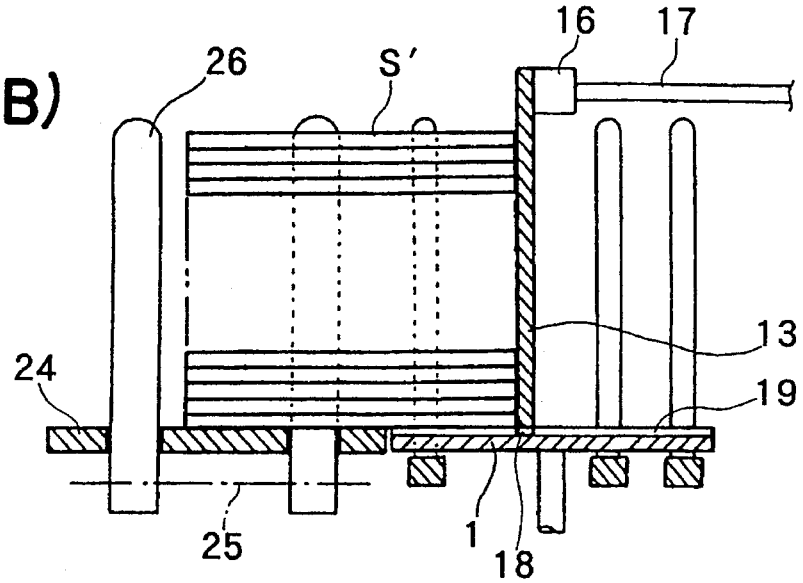
Figure 7C:
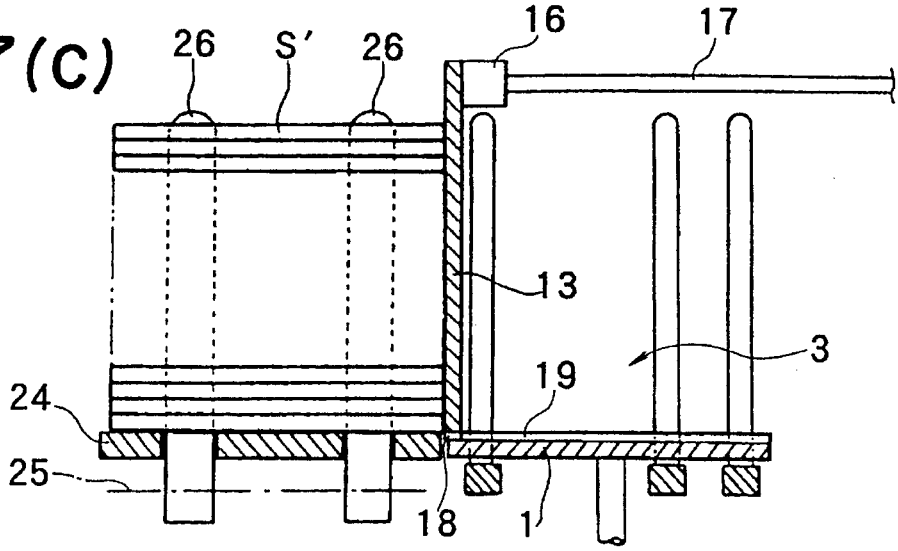
Figure 8:
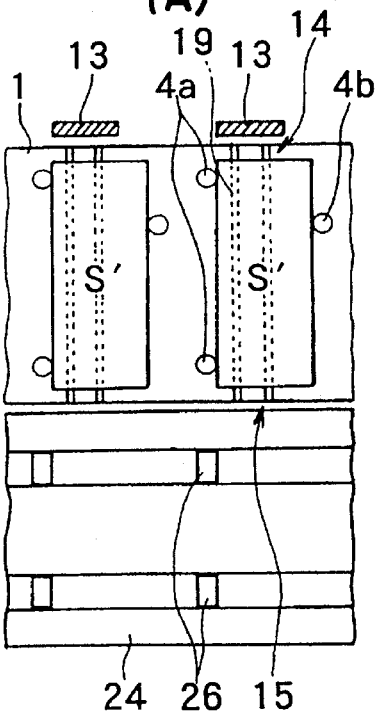
FIGS. 8(A), 8(B) and 8(C) are plan view of the sheet-bundle stacking portion and expulsion portion, for use in explaining the process of operation thereof.
Figure 8:
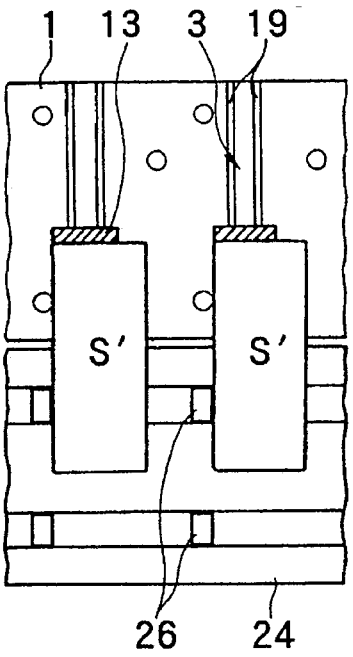
Figure 8:
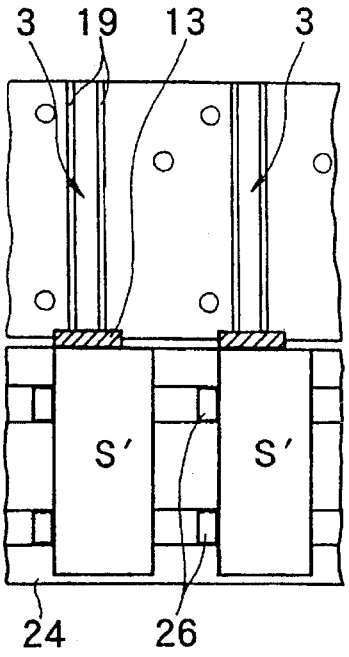

That is, as shown in FIG. 7, when the block S' is pushed out by the expulsion pusher 13, the auxiliary pressing portion 18 extends downwardly of the block S' and moves within the groove 19. By this, there can be prevented such troubles in which the lowermost sheet of the block S' becomes trapped between the expulsion pusher 13 and the stacking table 1 the sheet and the apparatus to be stopped. As a result, the overall blocks can be expelled correctly. It is designed such that the auxiliary pressing portion 18 is moved within the groove 19 with a small space left between the pusher 13 and the inner surface of the groove 19, in order to not disturb the reciprocal movement of the expulsion pusher 13. Therefore, as shown in FIG. 8, each block S' is formed on each groove 19 which is formed in the upper surface of the stacking table 1 for each collection station 3.

Figure 9:
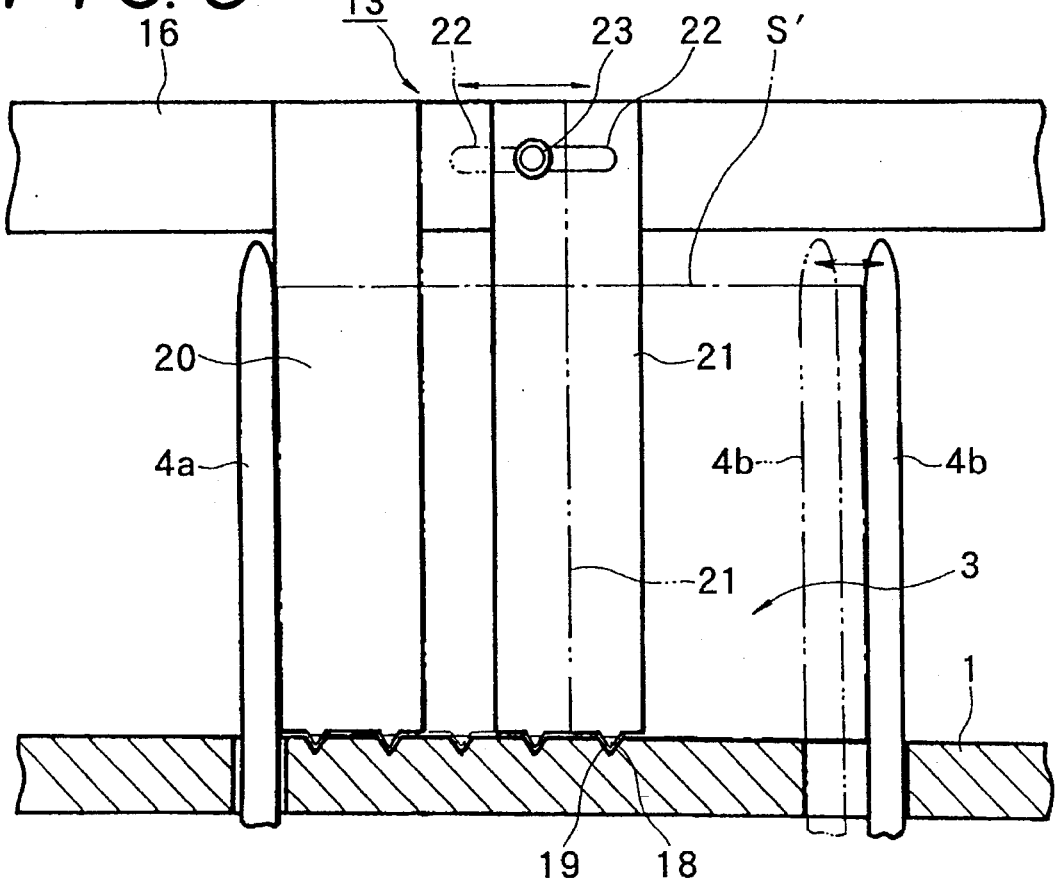
FIG. 9 is a sectional view showing an example of an expulsion pusher viewed from the front.

FIG. 9 shows one example of the unit expulsion pusher 13. The unit expulsion pusher 13 in the given example comprises a first pressing portion 20 firmly secured to the connection frame 16 and a second pressing portion 21 movably mounted thereon. By changing the mounting position of the second pressing portion 21, changes in size of the bundles of sheets S can be correctly accommodated, where necessary. In other words, each expulsion pusher 13 is of a construction in which the width of its pressing surface against each block S' can be adjusted. As depicted in FIG. 9, when the mounting position of the second pressing portion 21 is changed, the position of the guide pin **4*b* can also be changed by moving the guide pin 4*b* toward or away from the guide pins 4*a*. As shown in FIGS. 3 and 9**, this movement is accommodated by the stacking table by the provision of an elongate hole formed through the stacking table.

The second pressing portion 21 has a slit 22 formed in its connection area with the connection frame 16. The second pressing portion 21 is secured to the connection frame 16 by appropriate means such as a bolt 23 to be tightened through the slit 22. In accordance with the width of the bundles of sheets S, the second pressing portion 21 is moved in the longitudinal direction of the stacking table 1 along the slit 22 and bolted 23 at an appropriate position. The first pressing portion 20 thus secured restricts one side surface of the bundles of sheets S, which are different in size, always on the same reference line, while the second pressing portion 21 is moved in accordance with the size of the bundles of sheets S. By appropriately moving the second pressing portion 21, the pressing width of the block S' is adjusted to meet any change in size of the bundles of sheets S.

On the outlet port 15 side of the blocks S', the elongate expulsion table 24 extends in parallel relation with the stacking table 1. It is designed such that when the stacking table 1 is lowered to the lowermost position and blocks S' of a constant number of bundles of sheets S are formed, the upper surface of the expulsion table 24 is generally flush with the upper surface of the stacking table 1. The blocks S' pushed out of the outlet ports 15 of the collection stations 3, respectively, by the unit expulsion pushers 13 are received on the upper surface of the expulsion table 24.

The expulsion table 24 includes an endless traveling body 25 capable of traveling longitudinally of the table 24. The endless traveling body 25 is provided with transfer pushers 26 which are spacedly arranged thereon such that the pushers 26 correspond to the guide pins **4*a* of the unit guide pins 4. The blocks S' on the expulsion table 24 are transferred in the longitudinal direction of the expulsion table 24 by the transfer pushers 26** and delivered to the subsequent process from one end thereof.

During the time the blocks S' are being transferred to the subsequent process, the stacking operation of the bundles of sheets S onto the stacking table 1 is continued and the next blocks S' of the bundles of sheets S are formed on the stacking table 1. Namely, the transferring operation of the blocks S' to the subsequent process and the operation for forming the next blocks S' of the bundles of sheets S are simultaneously performed.

According to the present invention, when the shutter member is opened at its one side in order to drop the bundles of sheets from the shutter member onto the stacking table such that the bundles of sheets are stacked up in their horizontal posture thereon, the bundles of sheets are prevented from movement by the stationary ruler member disposed on the openable-side. Accordingly, there can be effectively prevented a possible movement of the bundles of sheets following the opening action of the shutter member. Thus, it is ensured that the bundles of sheets are always dropped in a predetermined location.

Also, since the shutter member for supporting the bundles of sheets at one side thereof is of a single-side-openable structure, the apparatus for stacking bundles of sheets can be simplified in structure. Further, since the other end side of the shutter member is normally open, the bundles of sheets are not restricted. If the shutter member has a satisfactory width which is not necessarily very large, it can properly meet any change in size of the bundles of sheets whenever necessary.

Since the group of many blocks of the bundles of sheets stacked and supported in a row on the stacking table are simultaneously expelled from the stacking table in a direction of its one side, the blocks can be expelled from the stacking table in a comparatively short time, thus enabling the starting of the next stacking operation immediately. Therefore, the cycle from the time for stacking the bundles of sheets to the time for expelling the blocks of the bundles of sheets is short. Therefore, there can be obviated the problem inherent in the conventional devices that the next stacking operation is interrupted during the time the blocks are expelled, one-by-one, from one end of the stacking table. As a result, the present invention can improve the working efficiency and meet the requirement of a high speed operation.

Also, since the group of the blocks of the bundles of sheets can be simultaneously expelled by the expulsion pushers in a direction perpendicular to the direction of the row of the group of the blocks, i.e., a direction perpendicular to the direction longitudinal direction of the stacking table, there can be obviated the problems inherent in the conventional devices that the sheet-blocks are scratched by the inner surfaces of the opposite side ruler plates. In addition, owing to the provision of a protrusion formed on a lower edge of each expulsion pusher, there can be effectively prevented the possible troubles in which the lowermost sheet moves beneath the lower edge of the expulsion pusher to generate a product of poor quality and requiring that the operation be stopped. Thus, the expelling operation can be performed in an efficient manner.

Also, owing to the arrangement in which the expulsion pusher member comprises a plurality of unit expulsion pusher members divided in such a manner as to correspond to the blocks, respectively, so that the pressing width of each unit expulsion pusher can be adjusted, any change in size of the bundles of sheets can be properly met, where necessary.

According to the present invention, through coaction of the stacking table, the single-side-openable shutter member, the stationary ruler member, and the expulsion pusher members, the operation for stacking the bundles of sheets can be performed at a high speed. The requirement of simplifying the structure is properly met. In this way, the present invention can resolve the various problems inherent in the conventional sheet-bundle stacking devices.

It is to be understood that the form of the invention herewith shown and described is to be taken as the preferred embodiment of the same, and that various changes in the shape, size and arrangement of parts may be resorted to without departing from the spirit of the invention or the scope of the subjoined claims.

What is claimed is:

1. An apparatus for stacking bundles of sheets, comprising:

an elongate stacking table capable of movement upwardly and downwardly, said stacking table being lowered in accordance with increase in stacking amount of the bundles of sheets;

a shutter member located above said stacking table so as to be movable between a support position at which the bundles of sheets are supported and a support-releasing position at which the bundles of sheets are simultaneously dropped onto said stacking table a plurality of reciprocally movable unit expulsion pushers adapted to push blocks of the bundles of sheets dropped onto and supported in a row in their horizontal posture by an upper surface of said stacking table simultaneously in the direction perpendicular to the direction of the blocks being arranged in a row, said unit expulsion pushers being divided so as to correspond in position to the respective blocks of the bundles of sheets stacked in their horizontal posture, and each unit expulsion pusher being adjustable in width of a pressing surface thereof to accommodate blocks of different widths.

2. An apparatus for stacking bundles of sheets as defined in claim 1, further comprising a stationary ruler member for restricting only one side of the bundle of sheets when the bundle of sheets is present on said shutter member and for preventing movement of the bundle of sheets during movement of the shutter member from its support position to its support-releasing position.

3. An apparatus for stacking bundles of sheets, comprising:

an elongate stacking table capable of movement upwardly and downwardly, said stacking table being lowered in accordance with increase in stacking amount of the bundles of sheets;

a shutter member located above said stacking table so as to be movable between a support position at which the bundles of sheets are supported and a support-releasing position at which the bundles of sheets are simultaneously dropped onto said stacking table;

a reciprocally movable expulsion pusher for pushing blocks of the bundles of sheets dropped onto and supported in a row in their horizontal posture by an upper surface of said stacking table so that the blocks are moved simultaneously in the direction perpendicular to the direction of the blocks being arranged in a row; and at least one pair of guide pins protruding upwardly above said upper surface of said stacking table, said guide pins being spaced apart from one another in a longitudinal direction of said stacking table so as to receive the bundles of sheets therebetween, and one of said pair of guide pins being movable toward and away from the other of said pair of guide pins in said longitudinal direction of said stacking table to accommodate bundles of sheets having different widths.

4. An apparatus for stacking bundles of sheets as defined in claim 3, wherein said guide pins are cylindrical.

5. An apparatus for stacking bundles of sheets as defined in claim 3, wherein said at least one pair of said guide pins comprises a plurality of pairs of said guide pins arranged successively along said longitudinal direction of said stacking table.

6. An apparatus for stacking bundles of sheets, comprising:

an elongate stacking table capable of movement upwardly and downwardly, said stacking table being lowered in accordance with increase in stacking amount of the bundles of sheets;

a shutter member located above said stacking table so as to be movable between a support position at which the bundles of sheets are supported and a support-releasing position at which the bundles of sheets are simultaneously dropped onto said stacking table;

a reciprocally movable expulsion pusher adapted to push blocks of the bundles of sheets dropped onto and supported in a row in their horizontal posture by an upper surface of said stacking table simultaneously in the direction perpendicular to the direction of the blocks being arranged in a row;

wherein said stacking table has a guide groove formed in said upper surface thereof and extending in a direction perpendicular to a longitudinal direction of said stacking table; and wherein said expulsion pusher is provided at a lower end thereof with an auxiliary pressing portion movably disposed in said guide groove of said stacking table.

7. An apparatus for stacking tables of sheets as defined in claim 6, wherein said expulsion pusher includes a plurality of unit expulsion pushers divided so as to correspond in position to the respective blocks of the bundles of sheets stacked in their horizontal posture on said stacking table and said guide groove formed in said upper surface of said stacking table includes a plurality of guide grooves located so as to respectively correspond in position to the respective blocks of the bundles of sheets stacked in their horizontal posture on said stacking table.

* * * * *